US005977755A

United States Patent [19]

Miki et al.

[11] Patent Number: 5,977,755

[45] Date of Patent: Nov. 2, 1999

[54] CONSTANT-VOLTAGE POWER SUPPLY CIRCUIT

[75] Inventors: Takeshi Miki; Junji Hayakawa, both of Okazaki; Hiroyuki Ban, Aichi-ken, all of Japan

[73] Assignee: Denso Corporation, Kariya, Japan

[21] Appl. No.: 09/140,415

[22] Filed: Aug. 26, 1998

[30] Foreign Application Priority Data

Aug. 26, 1997 [JP] Japan ..... 9-229487

[51] Int. Cl.[6] ..... G05F 1/40

[52] U.S. Cl. ..... 323/269

[58] Field of Search ..... 323/266, 269, 323/273, 282; 307/30–35, 38, 39

[56] References Cited

U.S. PATENT DOCUMENTS 4,740,878 4/1988 Carter et al. ..... 363/63
5,179,358 1/1993 Martin ..... 331/1 A
5,574,633 11/1996 Prater ..... 363/59
5,701,072 12/1997 Jeon et al. ..... 323/312

*Primary Examiner*—Matthew Nguyen
*Attorney, Agent, or Firm*—Pillsbury Madison & Sutro LLP

[57] ABSTRACT

A constant-voltage power supply circuit includes a first output device provided in a first power feed line from a dc power supply to a first load. The first output device includes a first voltage control element for controlling an output voltage to the first load. A first control device operates for detecting the output voltage from the first output device to the first load, and controlling the first voltage control element to equalize the output voltage from the first output device with a first predetermined constant voltage. A second power feed line is connected to the first power feed line for feeding electric power to a second load. A second output device provided in the second power feed line includes a second voltage control element for controlling an output voltage to the second load. A second control device operates for detecting the output voltage from the second output device to the second load, and controlling the second voltage control element to equalize the output voltage from the second output device with a second predetermined constant voltage.

14 Claims, 6 Drawing Sheets

CONSTANT-VOLTAGE POWER SUPPLY CIRCUIT

BACKGROUND OF THE INVENTION

1. Field of the Invention

This invention relates to a constant-voltage power supply circuit which is able to feed constant voltages to plural loads respectively.

2. Description of the Related Art

It is known to use a plurality of constant-voltage power supply circuits in the case where different constant-voltages are required to be fed to separate loads respectively. This combination of the constant-voltage power supply circuits serves as a composite power supply circuit of a multiple-output type which is able to feed constant voltages to plural loads respectively. It tends to be difficult to make such a multiple-output constant-voltage power supply circuit into a single IC chip for some reasons. Accordingly, the reduction in size of the multiple-output constant-voltage power supply circuit is considerably limited.

SUMMARY OF THE INVENTION

It is an object of this invention to provide an improved constant-voltage power supply circuit which is able to feed constant voltages to plural loads respectively.

A first aspect of this invention provides a constant-voltage power supply circuit comprising first output means provided in a first power feed line from a dc power supply to a first load and including a first voltage control element for controlling an output voltage to the first load; first control means for detecting the output voltage from the first output means to the first load, and controlling the first voltage control element to equalize the output voltage from the first output means with a first predetermined constant voltage; a second power feed line connected to the first power feed line for feeding electric power to a second load; second output means provided in the second power feed line and including a second voltage control element for controlling an output voltage to the second load; and second control means for detecting the output voltage from the second output means to the second load, and controlling the second voltage control element to equalize the output voltage from the second output means with a second predetermined constant voltage.

A second aspect of this invention is based on the first aspect thereof, and provides a constant-voltage power supply circuit further comprising voltage-difference generation means provided in the first power feed line for generating a voltage difference equal to or greater than a voltage difference caused by the second output means when the second control means controls the second voltage control element to maximize the output voltage to the second load, the second power feed line being connected to a portion of the first power feed line between the voltage-difference generation means and the first output means, the first control means detecting an output voltage from the voltage-difference generation means to the first load.

A third aspect of this invention is based on the second aspect thereof, and provides a constant-voltage power supply circuit wherein the second voltage control element includes a MOS FET, and the voltage-difference generation means includes a diode for generating a voltage difference in response to a forward-direction voltage when a current flows therethrough, the second control means controlling the output voltage to the second load to be equal to the output voltage to the first load which is controlled by the first control means.

A fourth aspect of this invention is based on the third aspect thereof, and provides a constant-voltage power supply circuit further comprising voltage decision means for deciding whether or not the output voltage to the first load is lower than the output voltage to the second load, a second MOS FET connected in parallel with the voltage-difference generation means, and voltage-difference reducing means for, when the voltage decision means decides that the output voltage to the first load is lower than the output voltage to the second load, controlling the second MOS FET to reduce the voltage difference to equalize the output voltage to the first load with the output voltage to the second load.

A fifth aspect of this invention is based on the second aspect thereof, and provides a constant-voltage power supply circuit wherein the second voltage control element includes a first MOS FET, and the voltage-difference generation means includes a second MOS FET and a first drive circuit, the second MOS FET being provided in the first power feed line, the first drive circuit controlling the second MOS FET to be in its on state, the second control means controlling the output voltage to the second load to be equal to the output voltage to the first load which is controlled by the first control means.

A sixth aspect of this invention is based on one of the first, second, third, fourth, and fifth aspects thereof, and provides a constant-voltage power supply circuit further comprising a voltage booster circuit for boosting a power supply voltage supplied to the second control means into a high voltage, the second voltage control element including an n-channel MOS FET, and a second drive circuit for generating a control voltage corresponding to an output from the first control means in response to the high voltage generated by the voltage booster circuit, and controlling the n-channel MOS FET in response to the control voltage.

A seventh aspect of this invention is based on one of the first, second, third, fourth, fifth, and sixth aspects thereof, and provides a constant-voltage power supply circuit further comprising an IC chip containing all structure elements of the constant-voltage power supply circuit except the first output means.

An eighth aspect of this invention is based on the first aspect thereof, and provides a constant-voltage power supply circuit further comprising voltage drop detecting means provided in the second power feed line for detecting a voltage drop responsive to a current flowing along the second power feed line, and limiter means for limiting an output current from the second output means when the voltage drop detected by the voltage drop detecting means reaches a given voltage drop.

A ninth aspect of this invention provides a constant-voltage power supply circuit comprising a first output terminal; a second output terminal; a first transistor connected to the first output terminal and controlling a current flowing therethrough and toward the first output terminal; first means for controlling the first transistor to regulate a first output voltage which appears at the first output terminal; a second transistor connected between the second output terminal and a junction between the first transistor and the first output terminal, and controlling a current flowing therethrough and toward the second output terminal; and second means for controlling the second transistor to regulate a second output voltage which appears at the second output terminal.

A tenth aspect of this invention is based on the ninth aspect thereof, and provides a constant-voltage power supply circuit further comprising a diode connected between the first output terminal and a junction between the first transistor and the second transistor.

An eleventh aspect of this invention is based on the ninth aspect thereof, and provides a constant-voltage power supply circuit further comprising a MOS FET connected between the first output terminal and a junction between the first transistor and the second transistor, and third means for holding the MOS FET in its conductive state.

A twelfth aspect of this invention is based on the ninth aspect thereof, and provides a constant-voltage power supply circuit further comprising third means for equalizing the first and second output voltages.

A thirteenth aspect of this invention is based on the ninth aspect thereof, and provides a constant-voltage power supply circuit further comprising third means for limiting the current flowing through the second transistor and toward the second output terminal to within a given range.

DESCRIPTION OF THE PREFERRED EMBODIMENTS

A prior-art constant-voltage power supply circuit will be explained below for a better understanding of this invention.

Figure 1:
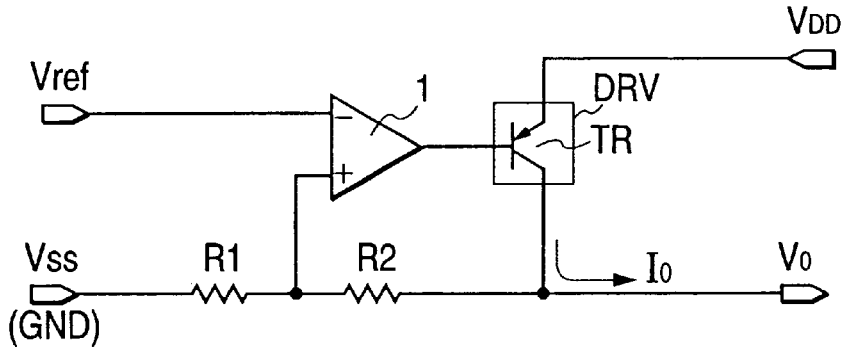
FIG. 1 PRIOR ART
FIG. 1 is a diagram of a prior-art constant-voltage power supply circuit.

FIG. 1 shows a prior-art constant-voltage power supply circuit which includes an operational amplifier 1, resistors R1 and R2, and a PNP transistor TR. The operational amplifier 1 serves as a comparator. The transistor TR forms an output circuit DRV. The prior-art constant-voltage power supply circuit of FIG. 1 is interposed between a dc power supply (not shown) and a load (not shown). The positive terminal of the dc power supply is connected to the emitter of the transistor TR. The negative terminal of the dc power supply is grounded.

In the prior-art constant-voltage power supply circuit of FIG. 1, the inverting input terminal of the operational amplifier 1 is subjected to a predetermined reference voltage Vref. A first end of the resistor R1 is grounded, being subjected to a ground potential Vss. A second end of the resistor R1 is connected to the non-inverting input terminal of the operational amplifier 1 and a first end of the resistor R2. The output terminal of the operational amplifier 1 is connected to the base of the transistor TR. A second end of the resistor R2 is connected to the collector of the transistor TR. The emitter of the transistor TR is connected to a dc power feed line subjected to a positive power supply potential VDD generated by the dc power supply. The junction between the resistor R2 and the collector of the transistor TR leads to a load (not shown).

In the prior-art constant-voltage power supply circuit of FIG. 1, an output voltage V0 from the output circuit DRV appears at the junction between the resistor R2 and the collector of the transistor TR. The combination of the resistors R1 and R2 divides the output voltage V0. The combination of the resistors R1 and R2 applies the division-resultant voltage to the non-inverting input terminal of the operational amplifier 1. The operational amplifier 1 compares the division-resultant voltage and the reference voltage Vref. The operational amplifier 1 controls the transistor TR in response to the result of the voltage comparison so that the division-resultant voltage and the reference voltage Vref will be equalized to each other. Specifically, when the division-resultant voltage is lower than the reference voltage Vref, the operational amplifier 1 reduces the voltage at the base of the transistor TR and hence increases the base current of the transistor TR to raise the output voltage V0. When the division-resultant voltage is higher than the reference voltage Vref, the operational amplifier 1 increases the voltage at the base of the transistor TR and hence decreases the base current of the transistor TR to lower the output voltage V0. Accordingly, the output voltage V0 is regulated at a given value depending on the reference voltage Vref and also the ratio between the resistances of the resistors R1 and R2. The regulated output voltage V0 is fed to the load. A current 10 referred to as a load current flows through the emitter-collector path of the transistor TR before entering the load.

It is known to use a plurality of constant-voltage power supply circuits in the case where different constant-voltages are required to be fed to separate loads respectively. In this case, each of the constant-voltage power supply circuits can use the prior-art constant-voltage power supply circuit of FIG. 1.

In the prior-art constant-voltage power supply circuit of FIG. 1, the load current I0 flows through the output circuit DRV so that electric power is consumed by the output circuit DRV. Thus, the output circuit DRV tends to be heated. Accordingly, in view of the heating of the output circuit DRV, it is improper to make the whole of the prior-art constant-voltage power supply circuit of FIG. 1 into a single IC chip. Specifically, the electric power W0 consumed by the output circuit DRV is expressed as follows.

$$W0=I0\cdot(VDD-V0) \quad (1)$$

where "I0" denotes the load current, and "VDD−V0" denotes the difference between the voltages at the two ends of the output circuit DRV.

For example, the prior-art constant-voltage power supply circuit of FIG. 1 has a form in which the operational amplifier 1 and the resistors R1 and R2 are contained in a single IC chip while the output circuit DRV is built in a block separate from the IC chip.

In the case where a plurality of the prior-art constant-voltage power supply circuits of FIG. 1 are combined into a multiple-output constant-voltage power supply circuit, a plurality of the output circuits DRV are built in respective blocks separate from an IC chip. Thus, the reduction in size of the multiple-output constant-voltage power supply circuit is considerably limited.

First Embodiment

Figure 2:
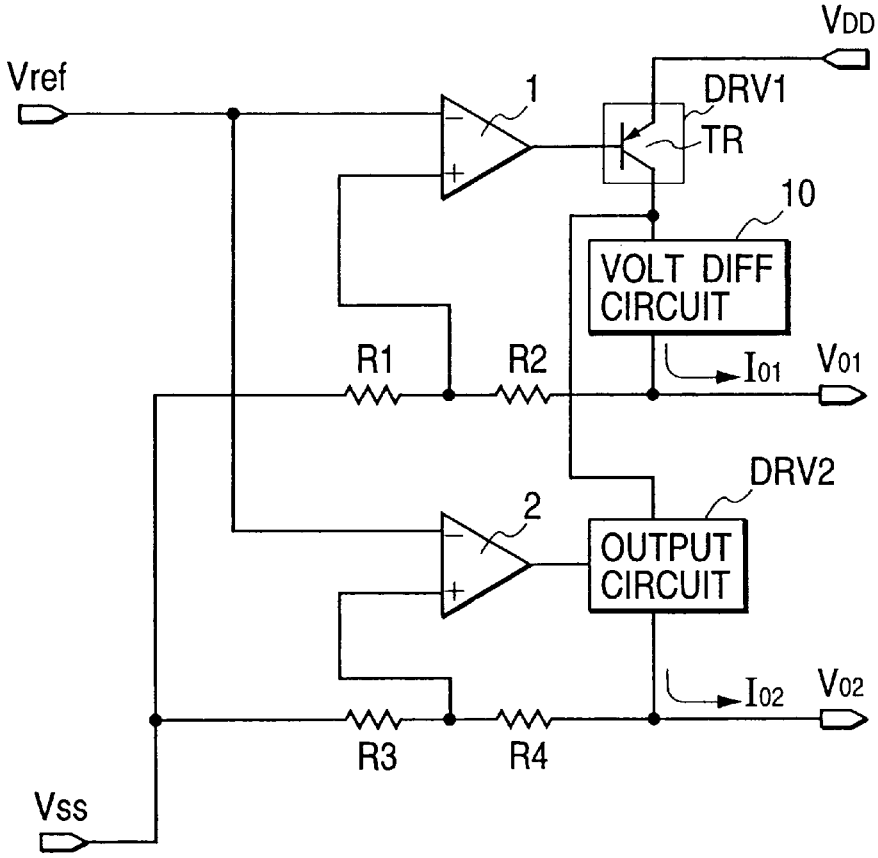
FIG. 2 is a diagram of a constant-voltage power supply circuit according to a first embodiment of this invention.

FIG. 2 shows a constant-voltage power supply circuit according to a first embodiment of this invention. The constant-voltage power supply circuit of FIG. 2 includes first and second constant-voltage output sections for feeding constant voltages V01 and V02 to first and second loads (not shown) respectively.

The first constant-voltage output section of the circuit of FIG. 2 includes an operational amplifier 1, resistors R1 and R2, a PNP transistor TR, and a voltage-difference generation circuit 10. The operational amplifier 1 serves as a comparator. The transistor TR forms an output circuit DRV1 which is interposed between a dc power supply (not shown) and the first load (not shown). The positive terminal of the dc power supply is connected to the emitter of the transistor TR. The negative terminal of the dc power supply is grounded.

The inverting input terminal of the operational amplifier 1 is subjected to a predetermined reference voltage Vref. A first end of the resistor R1 is grounded, being subjected to a ground potential Vss. A second end of the resistor R1 is connected to the non-inverting input terminal of the operational amplifier 1 and a first end of the resistor R2. The output terminal of the operational amplifier 1 is connected to the base of the transistor TR. A second end of the resistor R2 is connected via the voltage-difference generation circuit 10 to the collector of the transistor TR. The emitter of the transistor TR is connected to a dc power feed line subjected to a positive power supply potential VDD generated by the dc power supply. The junction between the resistor R2 and the voltage-difference generation circuit 10 leads to the first load (not shown) via a first output terminal.

A first output voltage V01 which appears at the junction between the resistor R2 and the voltage-difference generation circuit 10 is applied to the first load (not shown) via the first output terminal. The combination of the resistors R1 and R2 divides the first output voltage V01. The combination of the resistors R1 and R2 applies the division-resultant voltage to the non-inverting input terminal of the operational amplifier 1. The operational amplifier 1 compares the division-resultant voltage and the reference voltage Vref. The operational amplifier 1 controls the transistor TR in response to the result of the voltage comparison so that the division-resultant voltage and the reference voltage Vref will be equalized to each other. Specifically, when the division-resultant voltage is lower than the reference voltage Vref, the operational amplifier 1 reduces the voltage at the base of the transistor TR and hence increases the base current of the transistor TR to raise the first output voltage V01. When the division-resultant voltage is higher than the reference voltage Vref, the operational amplifier 1 increases the voltage at the base of the transistor TR and hence decreases the base current of the transistor TR to lower the first output voltage V01. Thus, the first output voltage V01 is regulated at a given value which depends on the reference voltage Vref and also the ratio between the resistances of the resistors R1 and R2 as expressed below.

$$V01=Vref\cdot(R1+R2)/R1$$

The regulated output voltage V01 is fed to the first load via the first output terminal. A current I01 referred to as a first load current flows through the emitter-collector path of the transistor TR and the voltage-difference generation circuit 10 before entering the first load.

The second constant-voltage output section of the circuit of FIG. 2 includes an operational amplifier 2, resistors R3 and R4, and an output circuit DRV2. Preferably, the output circuit DRV2 includes a PNP transistor as the output circuit DRV1 does. The output circuit DRV2 has an input electrode, an output electrode, and a control electrode. The input electrode of the output circuit DRV2 is connected to the junction between the voltage-difference generation circuit 10 and the collector of the transistor TR. The operational amplifier 2 serves as a comparator.

The inverting input terminal of the operational amplifier 2 is subjected to the reference voltage Vref. A first end of the resistor R3 is grounded, being subjected to the ground potential Vss. A second end of the resistor R3 is connected to the non-inverting input terminal of the operational amplifier 2 and a first end of the resistor R4. The output terminal of the operational amplifier 2 is connected to the control electrode of the output circuit DRV2. A second end of the resistor R4 is connected to the output electrode of the output circuit DRV2. The junction between the resistor R4 and the output circuit DRV2 leads to the second load (not shown) via a second output terminal.

An output voltage V02 from the output circuit DRV2 appears at the junction between the resistor R4 and the output circuit DRV2. The output voltage V02 from the output circuit DRV2 is referred to as the second output voltage V02. The combination of the resistors R3 and R4 divides the second output voltage V02. The combination of the resistors R3 and R4 applies the division-resultant voltage to the non-inverting input terminal of the operational amplifier 2. The operational amplifier 2 compares the division-resultant voltage and the reference voltage Vref. The operational amplifier 2 controls the output circuit DRV2 in response to the result of the voltage comparison so that the division-resultant voltage and the reference voltage Vref will be equalized to each other. Specifically, when the division-resultant voltage is lower than the reference voltage Vref, the operational amplifier 2 reduces the voltage at the control electrode of the output circuit DRV2 and hence increases the control-electrode current of the output circuit DRV2 to raise the second output voltage V02. When the division-resultant voltage is higher than the reference voltage Vref, the operational amplifier 2 increases the voltage at the control electrode of the output circuit DRV2 and hence decreases the control-electrode current of the output circuit DRV2 to lower the second output voltage V02. Thus, the second output voltage V02 is regulated at a given value which depends on the reference voltage Vref and also the ratio between the resistances of the resistors R3 and R4 as expressed below.

$$V02=Vref\cdot(R3+R4)/R3$$

The regulated output voltage V02 is fed to the second load via the second output terminal. A current I02 referred to as a second load current flows through the output circuits DRV1 and DRV2 before entering the second load.

In the constant-voltage power supply circuit of FIG. 2, the voltage-difference generation circuit 10 is interposed in the power feed line between the output circuit DRV1 and the first load. The voltage-difference generation circuit 10 is designed to produce a voltage difference equal to or greater than a voltage difference which occurs across the output circuit DRV2 when the output circuit DRV2 is controlled to maximize its output voltage. The power feed line for the second load extends from the junction between the output circuit DRV1 and the voltage-difference generation circuit 10, and passes through the output circuit DRV2.

In the constant-voltage power supply circuit of FIG. 2, the first load current I01 caused by the dc power supply (not shown) flows into the first load (not shown) via the output circuit DRV1 and the voltage-difference generation circuit 10. The first output voltage V01 applied to the first load is regulated at the given constant level by the operational amplifier 1. The second load current I02 caused by the dc power supply (not shown) flows into the second load (not shown) via the output circuits DRV1 and DRV2. The second output voltage V02 applied to the second load is regulated at the given constant level by the operational amplifier 2. In this way, the first and second constant voltages V01 and V02 are supplied to the first and second loads respectively. The first and second constant voltages V01 and V02 are independent of each other.

The electric power W1 consumed by the drive circuit DRV1 is expressed as follows.

$$W1=(I01+I02)\cdot(VDD-V01-V10) \quad (2)$$

where "V10" denotes the voltage difference produced by the voltage-difference generation circuit 10. The electric power W2 consumed by the drive circuit DRV2 is expressed as follows.

$$W2=I02\cdot(V01+V10-V02) \quad (3)$$

where "V10" denotes the voltage difference produced by the voltage-difference generation circuit 10. If the first and second load currents I01 and I02 are equal to the load current I0 in the equation (1) and the first and second output voltages V01 and V02 are equal to the output voltage V0 in the equation (1), the consumed electric powers W1 and W2 are simply expressed as follows.

$$W1=2\cdot I0\cdot(VDD-V0-V10) \quad (4)$$

$$W2=I0\cdot V10 \quad (5)$$

As understood from the equations (3) and (5), the electric power W2 consumed by the output circuit DRV2 is low provided that the second load current I02 is set to a small value. In the case where the consumed electric power W2 is low, it is proper to place the operational amplifiers 1 and 2, the resistors R1, R2, R3, and R4, the voltage-difference generation circuit 10, and the output circuit DRV2 in a single IC chip.

In the constant-voltage power supply circuit of FIG. 2, the voltage-difference generation circuit 10 is designed to produce a voltage difference equal to or greater than a voltage difference which occurs across the output circuit DRV2 when the output circuit DRV2 is controlled to maximize its output voltage. Accordingly, the voltage-difference generation circuit 10 enables the second output voltage V02 to be equal to or higher than the first output voltage V01. The voltage-difference generation circuit 10 may be removed in the case where the second output voltage V02 is set sufficiently lower than the first output voltage V01, and specifically in the case where the second output voltage V02 is set lower than the first output voltage V01 by a value corresponding to greater than the voltage difference across the output circuit DRV2.

Preferably, the output circuit DRV2 includes a PNP transistor as the output circuit DRV1 does. The transistor in the output circuit DRV2 may be replaced by another voltage control element such as an FET. The output circuit DRV2 may be provided with a smoothing circuit for stabilizing the second output voltage V02. The smoothing circuit includes, for example, a capacitor.

Preferably, the transistor TR in the output circuit DRV1 may be replaced by another voltage control element such as an FET. The output circuit DRV1 may be provided with a smoothing circuit for stabilizing the first output voltage V01. The smoothing circuit includes, for example, a capacitor.

The constant-voltage power supply circuit of FIG. 2 may be modified into a structure having three or more constant-voltage output sections for feeding constant voltages to separate loads respectively.

Second Embodiment

Figure 3:
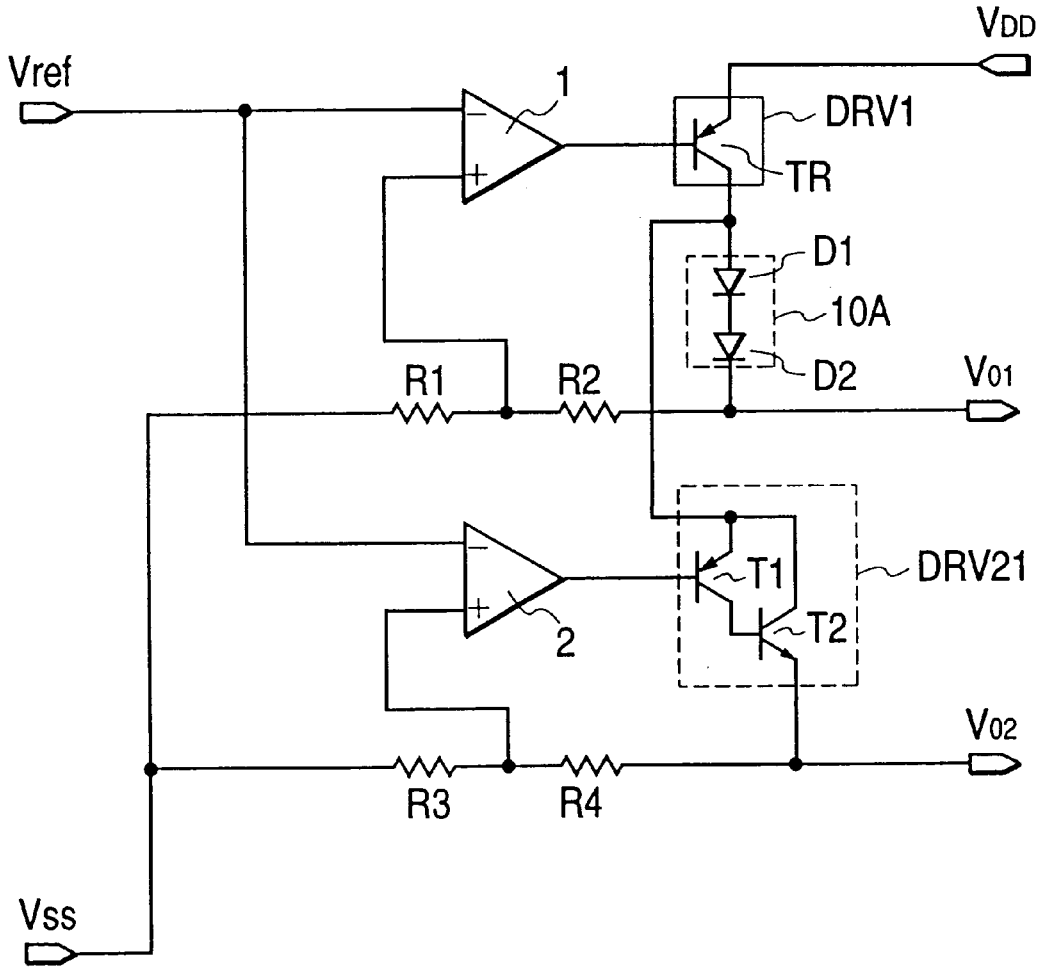
FIG. 3 is a diagram of a constant-voltage power supply circuit according to a second embodiment of this invention.

FIG. 3 shows a constant-voltage power supply circuit according to a second embodiment of this invention. The constant-voltage power supply circuit of FIG. 3 is similar to the constant-voltage power supply circuit of FIG. 2 except for design changes indicated hereinafter.

The constant-voltage power supply circuit of FIG. 3 includes a voltage-difference generation circuit 10A and an output circuit DRV21 which replace the voltage-difference generation circuit 10 (see FIG. 2) and the output circuit DRV2 (see FIG. 2) respectively.

In the constant-voltage power supply circuit of FIG. 3, the dc power supply is a vehicular battery or an automotive battery, and the positive power supply potential VDD is equal to, for example, +12 V. In addition, the first output voltage V01 and the second output voltage V02 are set equal to each other. For example, the first and second output voltages V01 and V02 are set to 5 V. The first and second loads (not shown) have, for example, a vehicular control device and a vehicular signal processing device respectively.

As shown in FIG. 3, the output circuit DRV21 includes a PNP transistor T1 and an NPN transistor T2 combined in Darlington connection. The emitter of the transistor T1 and the collector of the transistor T2 are connected in common to the junction between the output circuit DRV1 and the voltage-difference generation circuit 10A. The base of the transistor T1 is connected to the output terminal of the operational amplifier 2. The collector of the transistor T1 is connected to the base of the transistor T2. The emitter of the transistor T2 is connected to the second end of the resistor R4. The junction between the emitter of the transistor T2 and the second end of the resistor R4 leads to the second load (not shown) via the second output terminal.

In the constant-voltage power supply circuit of FIG. 3, the second output voltage V02 appears at the junction between the emitter of the transistor T2 and the second end of the resistor R4. The combination of the resistors R3 and R4 divides the second output voltage V02. The combination of the resistors R3 and R4 applies the division-resultant voltage to the non-inverting input terminal of the operational amplifier 2. The operational amplifier 2 compares the division-resultant voltage and the reference voltage Vref. The operational amplifier 2 controls the transistors T1 and T2 in response to the result of the voltage comparison so that the division-resultant voltage and the reference voltage Vref will be equalized to each other. Specifically, when the division-resultant voltage is lower than the reference voltage Vref, the operational amplifier 2 reduces the voltage at the base of the transistor T1 and hence increases the base currents of the transistors T1 and T2 to raise the second output voltage V02. When the division-resultant voltage is higher than the reference voltage Vref, the operational amplifier 2 increases the voltage at the base of the transistor T1 and hence decreases the base currents of the transistors T1 and T2 to lower the second output voltage V02. Thus, the second output voltage V02 is regulated at a given value (for example, 5 V) which depends on the reference voltage Vref and also the ratio between the resistances of the resistors R3 and R4.

As previously indicated, the first and second output voltages V01 and V02 are equal to each other. Accordingly, the voltage difference generated by the voltage-difference generation circuit 10A is set equal to or greater than the voltage difference across the output circuit DRV21.

As shown in FIG. 3, the voltage-difference generation circuit 10A includes diodes D1 and D2 connected in series or cascade along the forward direction with respect to the first load current I01 (see FIG. 2). The anode of the diode D1 is connected to the collector of the transistor TR in the output circuit DRV1. The cathode of the diode D1 is connected to the anode of the diode D2. The cathode of the diode D2 is connected to the second end of the resistor R2. The junction between the cathode of the diode D2 and the second end of the resistor R2 leads to the first load (not shown) via the first output terminal. The first output voltage V01 appears at the junction between the cathode of the diode D2 and the second end of the resistor R2.

The voltage difference produced by the voltage-difference generation circuit 10A agrees with the sum of the threshold voltage related to the diode D1 and the threshold voltage related to the diode D2. The voltage difference produced by the voltage-difference generation circuit 10A is equal to, for example, about 1.4 V. In addition, the voltage difference produced by the voltage-difference generation circuit 10A is greater than a voltage difference which occurs across the output circuit DRV21 when the output circuit DRV21 is controlled to maximize its output voltage. The voltage difference across the output circuit DRV21 is equal to the sum of the voltage VBE between the base and the emitter of the transistor T2 and the voltage VCE between the collector and the emitter of the transistor T1. The first and second output voltages V01 and V02 are regulated at the same level.

In the constant-voltage power supply circuit of FIG. 3, since the transistors T1 the transistors T1 and T2 compose the output circuit DRV21, the electric power consumed by the output circuit DRV21 can be sufficiently limited. Since the diodes D1 and D2 compose the voltage-difference generation circuit 10A, the electric power consumed by the voltage-difference generation circuit 10A can be sufficiently limited. Therefore, it is proper to place the operational amplifiers 1 and 2, the resistors R1, R2, R3, and R4, the voltage-difference generation circuit 10A, and the output circuit DRV21 in a single IC chip.

Third Embodiment

Figure 4:
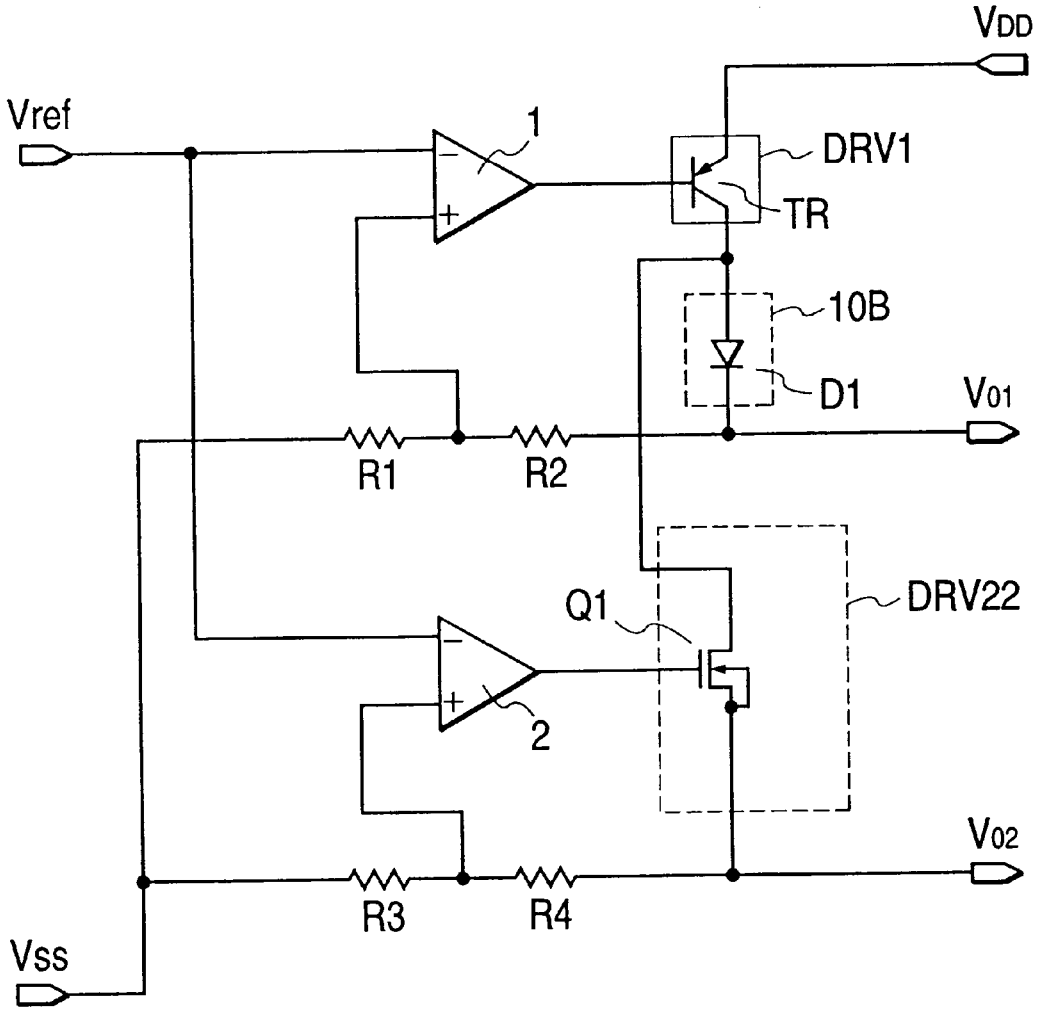
FIG. 4 is a diagram of a constant-voltage power supply circuit according to a third embodiment of this invention.

FIG. 4 shows a constant-voltage power supply circuit according to a third embodiment of this invention. The constant-voltage power supply circuit of FIG. 4 is similar to the constant-voltage 20 power supply circuit of FIG. 2 except for design changes indicated hereinafter.

The constant-voltage power supply circuit of FIG. 4 includes a voltage-difference generation circuit 10B and an output circuit DRV22 which replace the voltage-difference generation circuit 10 (see FIG. 2) and the output circuit DRV2 (see FIG. 2) respectively.

As shown in FIG. 4, the output circuit DRV22 includes an n-channel MOS FET Q1. The drain of the FET Q1 is connected to the junction between the output circuit DRV1 and the voltage-difference generation circuit 10B. The gate of the FET Q1 is connected to the output terminal of the operational amplifier 2. The source of the FET Q1 is connected to the second end of the resistor R4. The junction between the source of the FET Q1 and the second end of the resistor R4 leads to the second load (not shown) via the second output terminal.

In the constant-voltage power supply circuit of FIG. 4, the non-inverting input terminal of the operational amplifier 2 is subjected to the reference voltage Vref. The inverting input terminal of the operational amplifier 2 is connected to the junction between the resistors R3 and R4. The second output voltage V02 appears at the junction between the source of the FET Q1 and the second end of the resistor R4. The combination of the resistors R3 and R4 divides the second output voltage V02. The combination of the resistors R3 and R4 applies the division-resultant voltage to the inverting input terminal of the operational amplifier 2. The operational amplifier 2 compares the division-resultant voltage and the reference voltage Vref. The operational amplifier 2 controls the FET Q1 in response to the result of the voltage comparison so that the division-resultant voltage and the reference voltage Vref will be equalized to each other. Specifically, when the division-resultant voltage is lower than the reference voltage Vref, the operational amplifier 2 increases the voltage at the gate of the FET Q1 and hence increases the drain current of the FET Q1 to raise the second output voltage V02. When the division-resultant voltage is higher than the reference voltage Vref, the operational amplifier 2 decreases the voltage at the gate of the FET Q1 and hence decreases the drain current of the FET Q1 to lower the second output voltage V02. Thus, the second output voltage V02 is regulated at a given value which depends on the reference voltage Vref and also the ratio between the resistances of the resistors R3 and R4.

In the case where the output circuit DRV22 is formed by the FET Q1, the voltage drop (the voltage difference) which occurs across the output circuit DRV22 can be sufficiently smaller than the threshold voltage related to a typical diode. Thus, as shown in FIG. 4, a single diode D1 is used as the voltage-difference generation circuit DRV22. The diode D1 is placed in the forward direction with respect to the first load current I01 (see FIG. 2). The anode of the diode D1 is connected to the collector of the transistor TR in the output circuit DRV1. The cathode of the diode D1 is connected to the second end of the resistor R2. The junction between the cathode of the diode D1 and the second end of the resistor R2 leads to the first load (not shown) via the first output terminal. The first output voltage V01 appears at the junction between the cathode of the diode D1 and the second end of the resistor R2.

In the constant-voltage power supply circuit of FIG. 4, the first and second output voltages V01 and V02 can be regulated at the same level. The output circuit DRV22 consumes reduced electric power provided that the voltage difference which occurs across the output voltage DRV22 is set lower. Thus, it is proper to place the operational amplifiers 1 and 2, the resistors R1, R2, R3, and R4, the voltage-difference generation circuit 10B, and the output circuit DRV22 in a single IC chip.

The n-channel MOS FET Q1 in the output circuit DRV22 may be replaced by a p-channel MOS FET. In this case, the source of the p-channel MOS FET is connected to the junction between the output circuit DRV1 and the voltage-difference generation circuit 10B. The gate of the p-channel MOS FET is connected to the output terminal of the operational amplifier 2. The drain of the p-channel MOS FET is connected to the second end of the resistor R4. The junction between the drain of the p-channel MOS FET and the second end of the resistor R4 leads to the second load (not shown) via the second output terminal. Furthermore, the inverting input terminal of the operational amplifier 2 is subjected to the reference voltage Vref. The non-inverting input terminal of the operational amplifier 2 is connected to the junction between the resistors R3 and R4.

Fourth Embodiment

Figure 5:
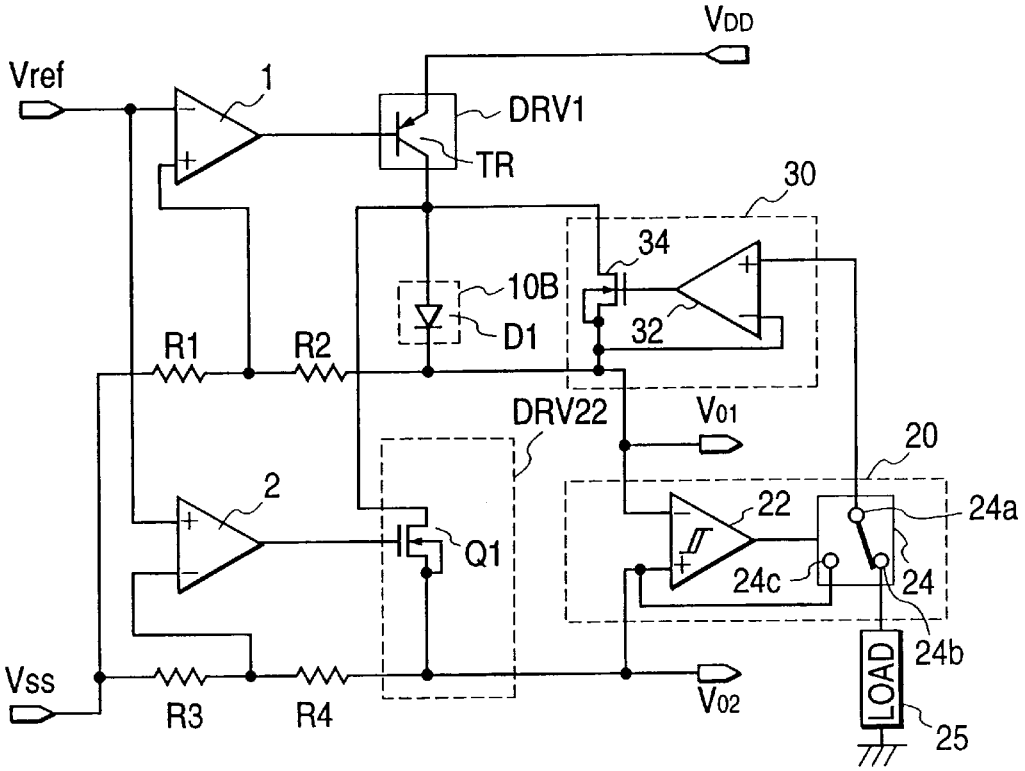
FIG. 5 is a diagram of a constant-voltage power supply circuit according to a fourth embodiment of this invention.

FIG. 5 shows a constant-voltage power supply circuit according to a fourth embodiment of this invention. The constant-voltage power supply circuit of FIG. 5 is similar to the constant-voltage power supply circuit of FIG. 4 except for an additional arrangement indicated hereinafter.

The constant-voltage power supply circuit of FIG. 5 includes a voltage decision circuit 20 and a voltage-difference reducing circuit 30. The voltage decision circuit 20 decides whether or not the first output voltage V01 is lower than the second output voltage V02. When the voltage decision circuit 20 decides that the first output voltage V01 is lower than the second output voltage V02, the voltage-difference reducing circuit 30 operates to move the first output voltage V01 into agreement with the second output voltage V02.

As shown in FIG. 5, the voltage decision circuit 20 includes a comparator 22 and a switch 24. A first input terminal of the comparator 22 is connected to the junction between the voltage-difference generation circuit 10B and the resistor R2, being subjected to the first output voltage V01. A second input terminal of the comparator 22 is connected to the junction between the resistor R4 and the FET Q1 in the output circuit DRV22, being subjected to the second output voltage V02. The switch 24 has a control terminal, a movable contact 24*a*, and two fixed contacts 24*b* and 24*c*. The output terminal of the comparator 22 is connected to the control terminal of the switch 24. Accordingly, the output signal of the comparator 22 is applied to the control terminal of the switch 24. The movable contact 24*a* of the switch 24 selectively connects with either the fixed contact 24*b* or the fixed contact 24*c* thereof in response to the logic state of the output signal of the comparator 22. The fixed contact 24*b* of the switch 24 is grounded via a suitable load 25 such as a resistor. The fixed contact 24*c* of the switch 24 is connected to the junction between the resistor R4 and the FET Q1 in the output circuit DRV22, being subjected to the second output voltage V02.

As shown in FIG. 5, the voltage-difference reducing circuit 30 includes an operational amplifier 32 and an n-channel MOS FET 34. The operational amplifier 32 serves as a differential amplifier. The non-inverting input terminal of the operational amplifier 32 is connected to the movable contact 24*a* of the switch 24. The inverting input terminal of the operational amplifier 32 is connected to the junction between the voltage-difference generation circuit 10B and the resistor R2, being subjected to the first output voltage V01. The output terminal of the operational amplifier 32 is connected to the gate of the FET 34. The drain of the FET 34 is connected to the junction between the output circuit DRV1 and the voltage-difference generation circuit 10B. The source of the FET 34 is connected to the junction between the voltage-difference generation circuit 10B and the resistor R2, being subjected to the first output voltage V01.

In the constant-voltage power supply circuit of FIG. 5, the comparator 22 compares the first and second output voltages V01 and V02 with each other. When the first output voltage V01 is lower than the second output voltage V02, the comparator 22 controls the switch 24 so that the movable contact 24*a* thereof will connect with the fixed contact 24*c* thereof. Accordingly, in this case, the second output voltage V02 is applied to the operational amplifier 32 via the switch 24. When the first output voltage V01 is equal to or higher than the second output voltage V02, the comparator 22 controls the switch 24 so that the movable contact 24*a* thereof will connect with the fixed contact 24*b* thereof. Accordingly, in this case, the ground potential Vss is applied to the operational amplifier 32 via the switch 24.

When the first output voltage V01 becomes lower than the second output voltage V02, the comparator 22 controls the switch 24 to apply the second output voltage V02 to the operational amplifier 32. In this case, the operational amplifier 32 responds to the first and second output voltages V01 and V02, and outputs a voltage to the gate of the FET 34 which depends on the difference between the first and second output voltages V01 and V02. Thus, the drain current of the FET 34 and also the first output voltage V01 vary in accordance with the difference between the first and second output voltages V01 and V02. Specifically, the FET 34 raises the first output voltage V01 into agreement with the second output voltage V02. Accordingly, the first output voltage V01 remains substantially equalized to the second output voltage V02.

Preferably, the comparator 22 uses a hysteresis-added Schmitt trigger circuit to prevent the occurrence of hunting due to variations in the first and second output voltages V01 and V02.

As understood from the previous description, the constant-voltage power supply circuit of FIG. 5 prevents the first output voltage V01 from decreasing below the second output voltage V02 even when the positive power supply potential VDD significantly drops.

Fifth Embodiment

Figure 6:
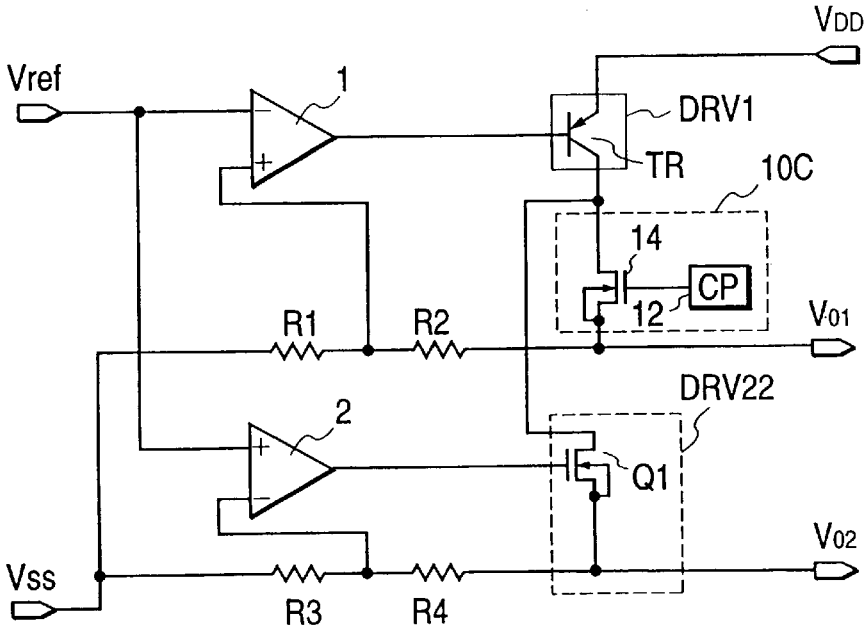
FIG. 6 is a diagram of a constant-voltage power supply circuit according to a fifth embodiment of this invention.

FIG. 6 shows a constant-voltage power supply circuit according to a fifth embodiment of this invention. The constant-voltage power supply circuit of FIG. 6 is similar to the constant-voltage power supply circuit of FIG. 4 except for a design change indicated hereinafter.

The constant-voltage power supply circuit of FIG. 6 includes a voltage-difference generation circuit 10C which replaces the voltage-difference generation circuit 10B (see FIG. 2).

As shown in FIG. 6, the voltage-difference generation circuit 10C includes a charge pump 12 and an n-channel MOS FET 14. The gate of the FET 14 is connected to the output terminal of the charge pump 12. The drain of the FET 14 is connected to the collector of the transistor TR in the output circuit DRV1. The source of the FET 14 is connected to the second end of the resistor R2. The junction between the source of the FET 14 and the second end of the resistor R2 leads to the first load (not shown) via the first output terminal. The first output voltage V01 appears at the junction between the source of the FET 14 and the second end of the resistor R2. The charge pump 12 continuously applies a high-level voltage to the gate of the FET 14, thereby holding the FET 14 in its on state (its conductive state).

In the constant-voltage power supply circuit of FIG. 6, the voltage difference produced by the voltage-difference generation circuit 10C is equal to the voltage difference which occurs when the output circuit DRV22 is controlled to maximize its output voltage. Accordingly, the first and second output voltages V01 and V02 can be continuously equal to each other. In addition, the output circuit DRV22 consumes reduced electric power.

Preferably, the constant-voltage power supply circuit of FIG. 6 except the output circuit DRV1 is built in a single IC chip. The charge pump 12 boosts a power supply voltage Vcc in the IC chip, thereby generating a high-level voltage. The charge pump 12 applies the high-level voltage to the gate of the FET 14.

To set the FET 14 in its on state, the voltage applied to the gate of the FET 14 from the charge pump 12 is made higher than the first output voltage V01 by a level greater than the threshold voltage related to the FET 14. The charge pump 12 boosts the power supply voltage Vcc to generate such a high-level voltage. Even in the case where the power supply voltage Vcc is equal to or lower than the first output voltage V01 or in the case where the power supply voltage Vcc drops due to a decrease in the positive power supply potential VDD, the voltage applied to the gate of the FET 14 from the charge pump 12 can be high enough to hold the FET 14 in its on state.

Figure 7:
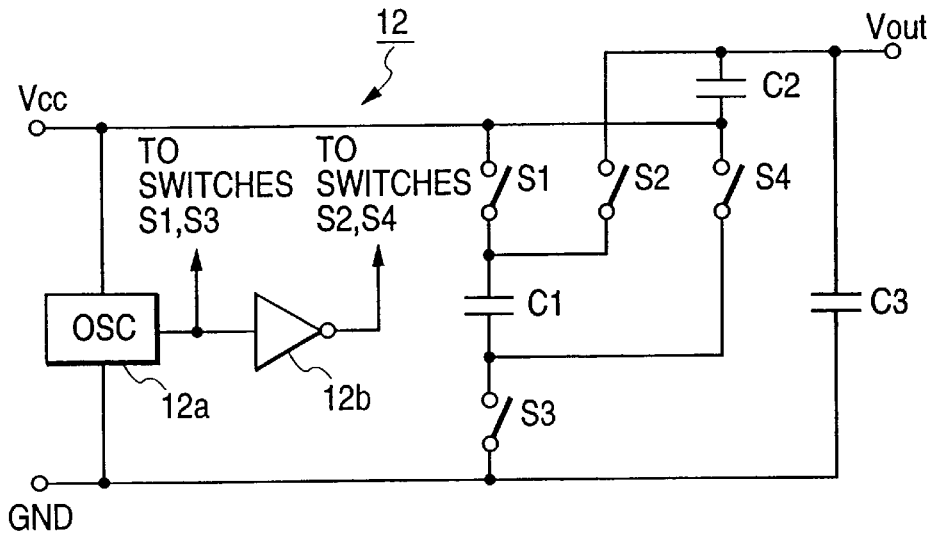
FIG. 7 is a diagram of a charge pump in FIG. 6.

As shown in FIG. 7, the charge pump 12 includes an oscillator 12*a*, an inverter 12*b*, analog switches S1, S2, S3, and S4, and capacitors C1, C2, and C3. The charge pump 12 is built in an IC chip having a power supply line subjected to a positive power supply voltage Vcc, and a ground line (GND) subjected to a ground potential.

The oscillator 12*a* is connected between the power supply line and the ground line, being activated by the power supply voltage Vcc. The oscillator 12*a* has an output terminal which is connected to the input terminal of the inverter 12*b* and the control terminals of the analog switches S1 and S3. The output terminal of the inverter 12*b* is connected to the control terminals of the analog switches S2 and S4.

A first end of the analog switch S1 is connected to the power supply line. A second end of the analog switch S1 is connected to a first end of the capacitor C1. A second end of the capacitor C1 is connected to a first end of the analog switch S3. A second end of the analog switch S3 is connected to the ground line.

A first end of the analog switch S2 is connected to a charge-pump output terminal leading to the gate of the FET 14 (see FIG. 6). A second end of the analog switch S2 is connected to the junction between the analog switch S1 and the capacitor C1. A first end of the capacitor C2 is connected to the charge-pump output terminal. A second end of the capacitor C2 is connected to the power supply line.

A first end of the switch S4 is connected to the power supply line. A second end of the switch S4 is connected to the junction between the capacitor C1 and the analog switch S3. A first end of the capacitor C3 is connected to the charge-pump output terminal. A second end of the capacitor C3 is connected to the ground line.

The oscillator 12*a* outputs a pulse signal to the input terminal of the inverter 12*b* and the control terminals of the analog switches S1 and S3. The pulse signal has a predetermined frequency and a predetermined period. The device 12*b* inverts the output signal of the oscillator 12*a*. The inverter 12*b* outputs the inversion-resultant signal to the control terminals of the analog switches S2 and S4. The analog switches S1 and S3 periodically change between their on states (their closed states) and their off states (their open states) in response to the output signal of the oscillator 12*a*. The analog switches S2 and S4 periodically change between their on states (their closed states) and their off states (their open states) in response to the output signal of the inverter 12*b*. When the analog switches S1 and S3 are in their on states, the analog switches S2 and S4 are in their off states. When the analog switches S1 and S3 are in their off states, the analog switches S2 and S4 are in their on states.

The charge pump 12 of FIG. 7 operates as follows. First, the analog switches S1 and S3 are changed to their on states so that the capacitor C1 is charged by the power supply voltage Vcc. Second, the analog switches S1 and S3 are changed to their off states while the analog switches S2 and S4 are changed to their on states. Therefore, charges are transferred from the capacitor C1 to the capacitor C2. Subsequently, charges are transferred from the capacitor C2 to the capacitor C3. In other words, the capacitor C3 is charged. The sequence of these steps are periodically repeated so that the capacitor C3 is repetitively charged. The charging of the capacitor C3 increases the voltage across the capacitor C3 above the power supply voltage Vcc. The voltage across the capacitor C3 is used as a high-level drive voltage Vout applied to the gate of the FET 14 (see FIG. 6).

Sixth Embodiment

Figure 8:
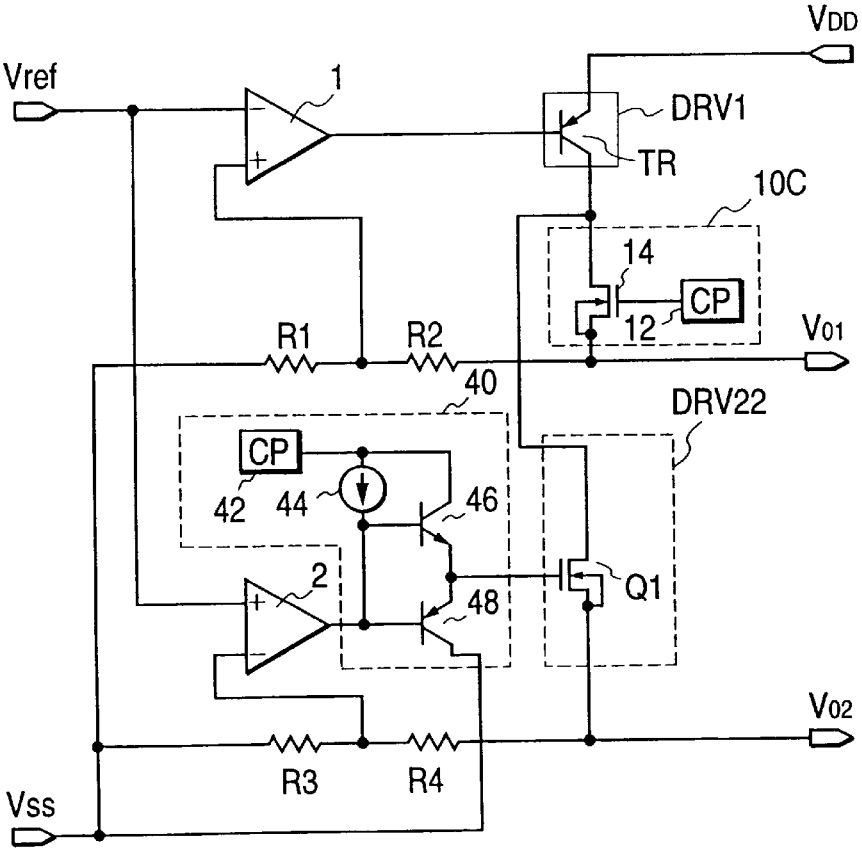
FIG. 8 is a diagram of a constant-voltage power supply circuit according to a sixth embodiment of this invention.

FIG. 8 shows a constant-voltage power supply circuit according to a sixth embodiment of this invention. The constant-voltage power supply circuit of FIG. 8 is similar to the constant-voltage power supply circuit of FIG. 6 except for an additional arrangement indicated hereinafter.

The constant-voltage power supply circuit of FIG. 8 includes a charge pump circuit 40 interposed between the operational amplifier 2 and the FET Q1 in the output circuit DRV22. The charge pump circuit 40 controls the FET Q1 in response to the output signal of the operational amplifier 2. The charge pump circuit 40 prevents the FET Q1 from being out of control even when the power supply voltage to the operational amplifier 2 drops.

As shown in FIG. 8, the charge pump circuit 40 includes a charge pump 42, a constant-current circuit 44, an NPN transistor 46, and a PNP transistor 48. The charge pump 42 is similar in structure to the charge pump 12 in the voltage-difference generation circuit 10C. The charge pump 42 serves as a voltage booster.

The emitters of the transistors 46 and 48 are connected in common to the gate of the FET Q1 in the output circuit DRV22. The collector of the NPN transistor 46 is connected to the output terminal of the charge pump 42. The collector of the PNP transistor 48 is grounded. The input side of the constant-current circuit 44 is connected to the output terminal of the charge pump 42. The output side of the constant-current circuit 44 is connected to the bases of the transistors 46 and 48 and the output terminal of the operational amplifier 2. The constant-current circuit 44 causes a constant current to flow from the charge pump 42 toward the bases of the transistors 46 and 48 and the output terminal of the operational amplifier 2.

The charge pump circuit 40 operates as follows. When the second output voltage V02 to the second load rises and hence the voltage outputted from the operational amplifier 2 drops, a greater portion of the current outputted from the constant-current circuit 44 flows toward the operational amplifier 2 so that the base currents of the transistors 46 and 48 decrease. The decreases in the base currents result in a drop of the voltage outputted from the charge pump circuit 40 to the FET Q1 in the output circuit DRV22. When the second output voltage V02 to the second load drops and hence the voltage outputted from the operational amplifier 2 rises, a smaller portion of the current outputted from the constant-current circuit 44 flows toward the operational amplifier 2 so that the base currents of the transistors 46 and 48 increase. The increases in the base currents result in a rise of the voltage outputted from the charge pump circuit 40 to the FET Q1 in the output circuit DRV22.

The output voltage from the charge pump circuit 40 to the FET Q1 in the output circuit DRV22 is generated on the basis of the high voltage produced by the charge pump 42. Accordingly, the output voltage from the charge pump circuit 40 to the FET Q1 is enabled to control the FET Q1. Thus, even in the case where the power supply voltage to the operational amplifier 2 drops, the FET Q1 can be reliably controlled in response to the output signal of the operational amplifier 2.

Seventh Embodiment

Figure 9:
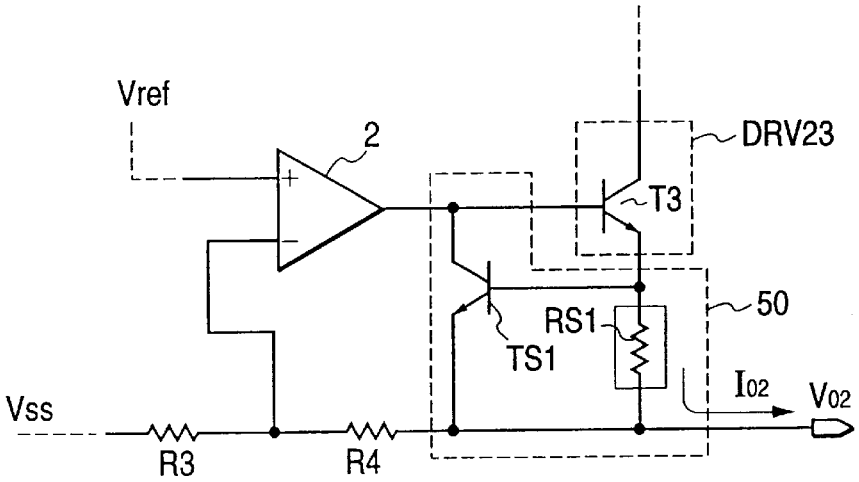
FIG. 9 is a diagram of a portion of a constant-voltage power supply circuit according to a seventh embodiment of this invention.

FIG. 9 shows a portion of a constant-voltage power supply circuit according to a seventh embodiment of this invention. The constant-voltage power supply circuit of FIG. 9 is similar to the constant-voltage power supply circuit of FIG. 2, FIG. 3, FIG. 4, FIG. 5, or FIG. 6 except for design changes indicated hereinafter.

In the constant-voltage power supply circuit of FIG. 9, an output circuit DRV23 connected to the output terminal of the operational amplifier 2 includes an NPN transistor (or an n-channel MOS FET) T3. The collector of the transistor T3 is connected to the output circuit DRV1 (see FIG. 2, FIG. 3, FIG. 4, FIG. 5, or FIG. 6). The base of the transistor T3 is connected to the output terminal of the operational amplifier 2.

The constant-voltage power supply circuit of FIG. 9 includes a limiter circuit 50. The constant-voltage power supply circuit is divided into the first and second constant-voltage output sections for generating the first and second output voltages V01 and V02 respectively. The limiter circuit 50 enables the first constant-voltage output section to operate normally even when the second load (not shown) or the power feed line to the second load short-circuits to the ground so that the second output voltage V02 drops to the ground potential.

As shown in FIG. 9, the limiter circuit 50 includes a resistor RS1 and an NPN transistor TS1. A first end of the resistor RS1 is connected to the emitter of the transistor T3 in the output circuit DRV23. A second end of the resistor RS1 is connected to the second end of the resistor R4. The junction between the resistors RS1 and R4 leads to the second load (not shown) via the second output terminal. The second output voltage V02 appears at the junction between the resistors RS1 and R4. The second load current I02 caused by the dc power supply (not shown) flows into the second load via the output circuit DRV23 and the resistor RS1. The resistor RS1 causes a voltage drop proportional to the second load current I02. The collector of the transistor TS1 is connected to the junction between the output terminal of the operational amplifier 2 and the base of the transistor T3 in the output circuit DRV23. The base of the transistor TS1 is connected to the junction between the resistor RS1 and the emitter of the transistor T3 in the output circuit DRV23. The emitter of the transistor TS1 is connected to the junction between the resistors RS1 and R4.

When the second load (not shown) or the power feed line to the second load short-circuits to the ground, the second output voltage V02 significantly drops. In this case, the operational amplifier 2 makes the transistor T3 fully conductive in response to the drop in the second output voltage V02. Thus, the second load current I02 increases, and the resistor RS1 causes a greater voltage drop. When the voltage drop across the resistor RS1 exceeds the threshold voltage Vf related to the transistor TS1, the transistor TS1 assumes its on state (its conductive state). Thus, the current outputted from the operational amplifier 2 flows toward the collector of the transistor TS1 rather than the base of the transistor T3. Accordingly, the base current of the transistor T3 is cut off, and the transistor T3 falls into to its off state (its non-conductive state). The transistor T3 which is in its off state prevents the drop in the second output voltage V02 from adversely affecting the first output voltage V01.

It should be noted that the limiter circuit 50 except the resistor RS1 may be integrated with the operational amplifier 2.

Eighth Embodiment

Figure 10:
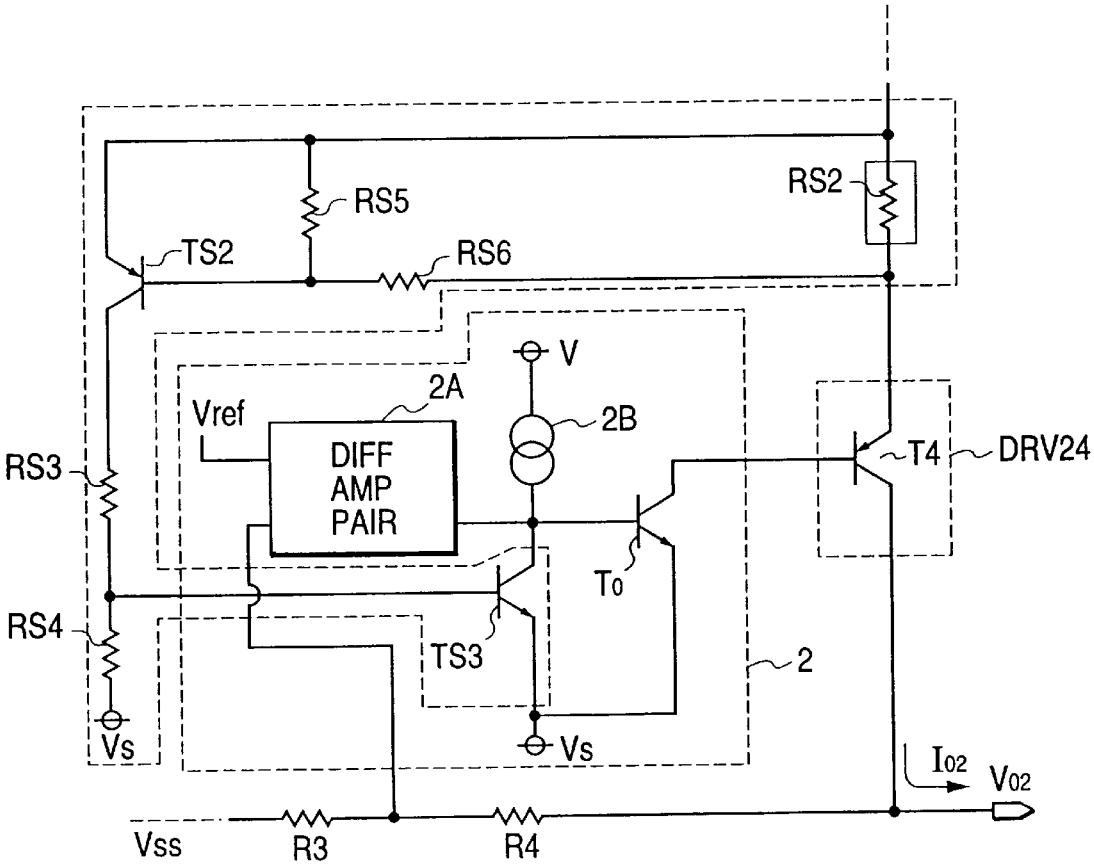
FIG. 10 is a diagram of a portion of a constant-voltage power supply circuit according to an eighth embodiment of this invention.

FIG. 10 shows a portion of a constant-voltage power supply circuit according to an eighth embodiment of this invention. The constant-voltage power supply circuit of FIG. 10 is similar to the constant-voltage power supply circuit of FIG. 2, FIG. 3, FIG. 4, FIG. 5, or FIG. 6 except for design changes indicated hereinafter.

In the constant-voltage power supply circuit of FIG. 10, an output circuit DRV24 connected to the output terminal of the operational amplifier 2 includes a PNP transistor (or a p-channel MOS FET) T4. The base of the transistor T4 is connected to the output terminal of the operational amplifier 2. The collector of the transistor T4 is connected to the second end of the resistor R4. The junction between the collector of the transistor T4 and the second end of the resistor R4 leads to the second load (not shown) via the second output terminal. The second output voltage V02 appears at the junction between the collector of the transistor T4 and the second end of the resistor R4.

The constant-voltage power supply circuit of FIG. 10 includes a limiter circuit 60. The constant-voltage power supply circuit is divided into the first and second constant-voltage output sections for generating the first and second output voltages V01 and V02 respectively. The limiter circuit 60 enables the first constant-voltage output section to operate normally even when the second load (not shown) or the power feed line to the second load short-circuits to the ground so that the second output voltage V02 drops to the ground potential.

As shown in FIG. 10, the limiter circuit 60 includes a PNP transistor TS2, an NPN transistor TS3, and resistors RS2, RS3, RS4, RS5, and RS6. A first end of the resistor RS2 is connected to the output circuit DRV1 (see FIG. 2, FIG. 3, FIG. 4, FIG. 5, or FIG. 6). A second end of the resistor RS2 is connected to the emitter of the transistor T4 in the output circuit DRV24. The second load current I02 caused by the dc power supply (not shown) flows into the second load (not shown) via the resistor RS2 and the output circuit DRV24. The resistor RS2 causes a voltage drop proportional to the second load current I02.

The emitter of the transistor TS2 is connected to the junction between the resistor RS2 and the output circuit DRV1 (see FIG. 2, FIG. 3, FIG. 4, FIG. 5, or FIG. 6). A first end of the resistor RS5 is 20 connected to the emitter of the transistor TS2. A second end of the resistor RS5 is connected to the base of the transistor TS2. The base of the transistor TS2 is connected via the resistor RS6 to the junction between the resistor RS2 and the emitter of the transistor T4 in the output circuit DRV24. The collector of the transistor TS2 is connected to a first end of the resistor RS3. A second end of the resistor RS3 is connected to a first end of the resistor RS4. A second end of the resistor RS4 is connected to a low-voltage line Vs such as a ground line subjected to a ground potential. The junction between the resistors RS3 and RS4 is connected to the base of the transistor TS3. The emitter of the transistor TS3 is connected to the low-voltage line Vs.

As shown in FIG. 10, the operational amplifier 2 includes a differential-amplifier pair 2A, a constant-current circuit 2B, an output transistor To, and the transistor TS3. Thus, the transistor TS3 is contained in both the limiter circuit 60 and the operational amplifier 2. The output transistor To uses an NPN transistor.

A first input terminal of the differential-amplifier pair 2A is subjected to the reference voltage Vref. A second input terminal of the differential-amplifier pair 2A is connected to the junction between the resistors R3 and R4. The output terminal of the differential-amplifier pair 2A is connected to the base of the transistor To and the collector of the transistor TS3. An input side of the constant-current circuit 2B is connected to a power supply line subjected to a positive power supply voltage Vop. An output side of the constant-current circuit 2B is connected to the junction among the output terminal of the differential-amplifier pair 2A, the base of the transistor To, and the collector of the transistor TS3. The collector of the transistor To is connected to the base of the transistor T4 in the output circuit DRV24. The emitter of the transistor To is connected to the low-voltage line Vs.

The differential-amplifier pair 2A compares the reference voltage Vref and the voltage at the junction between the resistors R3 and R4. The differential-amplifier pair 2A controls the transistor To in response to the result of the voltage comparison. When the differential-amplifier pair 2A outputs a high-level signal, a current flows into the base of the transistor To via the constant-current circuit 2B so that the transistor To assumes its on state. Thereby, the transistor T4 in the output circuit DRV24 changes to its on state, making effective the second output voltage V02 fed to the second load (not shown).

When the second load or the power feed line to the second load short-circuits to the ground, the second output voltage V02 significantly drops. In this case, the differential-amplifier pair 2A makes the transistor To fully conductive in response to the drop in the second output voltage V02. Thus, the transistor T4 in the output circuit DRV24 becomes also fully conductive, and the second load current I02 increases so that the resistor RS2 causes a greater voltage drop. When the voltage drop across the resistor RS2 exceeds the threshold voltage Vf related to the transistor TS2, the transistor TS2 assumes its on state (its conductive state). Thus, a current flows through the transistor TS2 and the resistors RS3 and RS4. The resistor RS4 causes a voltage drop proportional to the current flowing therethrough. When the voltage drop across the resistor RS4 exceeds the threshold voltage Vf related to the transistor TS3, the current outputted from the constant-current circuit 2B flows toward the collector of the transistor TS3 rather than the base of the transistor To. Accordingly, the base current of the transistor To is cut off, and the transistor To falls into its off state (its non-conductive state). When the transistor To changes to its off state, the transistor T4 in the output circuit DRV24 also falls into its off state (its non-conductive state). The transistor T4 which is in its off state prevents the drop in the second output voltage V02 from adversely affecting the first output voltage V01.

It should be noted that the limiter circuit 60 except the resistor RS2 may be integrated with the operational amplifier 2.

What is claimed is:

1. A constant-voltage power supply circuit comprising:

first output means provided in a first power feed line from a dc power supply to a first load and including a first voltage control element for controlling an output voltage to the first load;

first control means for detecting the output voltage from the first output means to the first load, and controlling the first voltage control element to equalize the output voltage from the first output means with a first predetermined constant voltage;

a second power feed line connected to the first power feed line for feeding electric power to a second load;

second output means provided in the second power feed line and connected to the dc power supply via the first output means, and including a second voltage control element for controlling an output voltage to the second load; and second control means for detecting the output voltage from the second output means to the second load, and controlling the second voltage control element to equalize the output voltage from the second output means with a second predetermined constant voltage.

2. A constant-voltage power supply circuit comprising:

first output means provided in a first power feed line from a dc power supply to a first load and including a first voltage control element for controlling an output voltage to the first load;

first control means for detecting the output voltage from the first output means to the first load, and controlling the first voltage control element to equalize the output voltage from the first output means with a first predetermined constant voltage;

a second power feed line connected to the first power feed line for feeding electric power to a second load;

second output means provided in the second power feed line and including a second voltage control element for controlling an output voltage to the second load;

second control means for detecting the output voltage from the second output means to the second load, and controlling the second voltage control element to equalize the output voltage from the second output means with a second predetermined constant voltage; and voltage-difference generation means provided in the first power feed line for generating a voltage difference equal to or greater than a voltage difference caused by the second output means when the second control means controls the second voltage control element to maximize the output voltage to the second load, the second power feed line being connected to a portion of the first power feed line between the voltage-difference generation means and the first output means, the first control means detecting an output voltage from the voltage-difference generation means to the first load.

3. A constant-voltage power supply circuit according to claim 2, wherein the second voltage control element includes a MOS FET, and the voltage-difference generation means includes a diode for generating a voltage difference in response to a forward-direction voltage when a current flows therethrough, the second control means controlling the output voltage to the second load to be equal to the output voltage to the first load which is controlled by the first control means.

4. A constant-voltage power supply circuit according to claim 3, further comprising voltage decision means for deciding whether or not the output voltage to the first load is lower than the output voltage to the second load, a second MOS FET connected in parallel with the voltage-difference generation means, and voltage-difference reducing means for, when the voltage decision means decides that the output voltage to the first load is lower than the output voltage to the second load, controlling the second MOS FET to reduce the voltage difference to equalize the output voltage to the first load with the output voltage to the second load.

5. A constant-voltage power supply circuit according to claim 2, wherein the second voltage control element includes a first MOS FET, and the voltage-difference generation means includes a second MOS FET and a first drive circuit, the second MOS FET being provided in the first power feed line, the first drive circuit controlling the second MOS FET to be in its on state, the second control means controlling the output voltage to the second load to be equal to the output voltage to the first load which is controlled by the first control means.

6. A constant-voltage power supply circuit comprising:

first output means provided in a first power feed line from a dc power supply to a first load and including a first voltage control element for controlling an output voltage to the first load;

first control means for detecting the output voltage from the first output means to the first load, and controlling the first voltage control element to equalize the output voltage from the first output means with a first predetermined constant voltage;

a second power feed line connected to the first power feed line for feeding electric power to a second load;

second output means provided in the second power feed line and including a second voltage control element for controlling an output voltage to the second load;

second control means for detecting the output voltage from the second output means to the second load, and controlling the second voltage control element to equalize the output voltage from the second output means with a second predetermined constant voltage; and a voltage booster circuit for boosting a power supply voltage supplied to the second control means into a high voltage, the second voltage control element including an n-channel MOS FET, and a second drive circuit for generating a control voltage corresponding to an output from the first control means in response to the high voltage generated by the voltage booster circuit, and controlling the n-channel MOS FET in response to the control voltage.

7. A constant-voltage power supply circuit according to claim 1, further comprising an IC chip containing all structure elements of the constant-voltage power supply circuit except the first output means.

8. A constant-voltage power supply circuit according to claim 1, further comprising voltage drop detecting means provided in the second power feed line for detecting a voltage drop responsive to a current flowing along the second power feed line, and limiter means for limiting an output current from the second output means when the voltage drop detected by the voltage drop detecting means reaches a given voltage drop.

9. A constant-voltage power supply circuit comprising:

a first output terminal;

a second output terminal;

a first transistor connected to the first output terminal and controlling a current flowing therethrough and toward the first output terminal;

first means for controlling the first transistor to regulate a first output voltage which appears at the first output terminal;

a second transistor connected between the second output terminal and a junction between the first transistor and the first output terminal, and controlling a current flowing therethrough and toward the second output terminal;

second means for controlling the second transistor to regulate a second output voltage which appears at the second output terminal; and a MOS FET connected between the first output terminal and a junction between the first transistor and the second transistor, and third means for holding the MOS FET in its conductive state.

10. A constant-voltage power supply circuit according to claim 9 further comprising fourth means for equalizing the first and second output voltages.

11. A constant-voltage power supply circuit according to claim 9 further comprising fourth means for limiting the current flowing through the second transistor and toward the second output terminal to within a given range.

12. A constant-voltage power supply circuit according to claim 2 further comprising a voltage booster circuit for boosting a power supply voltage supplied to the second control means into a high voltage; and the second voltage control element including an n-channel MOS FET and a second drive circuit for generating a control voltage corresponding to an output from the first control means in response to the high voltage generated by the voltage booster circuit, and controlling the n-channel MOS FET in response to the control voltage.

13. A constant-voltage power supply circuit according to claim 1, wherein the first output means receives a first power feed voltage from the dc power supply; and the second output means receives a second power feed voltage via the first output means from the dc power supply, the second power feed voltage being lower than the first power feed voltage.

14. A constant-voltage power supply circuit according to claim 1, wherein an electric power consumed by the first output means is greater than an electric power consumed by the second output means.

* * * * *